US005226182A

United States Patent [19]

Tucker

[11] Patent Number: 5,226,182

[45] Date of Patent: Jul. 13, 1993

[54] EXCREMENT COLLECTION AND DISPOSAL DEVICE AND METHOD

[76] Inventor: Marilyn Tucker, 9735 Orcas, Sunland, Calif. 91040

[21] Appl. No.: 830,716

[22] Filed: Feb. 4, 1992

[51] Int. Cl.[5] ..... A61G 9/00

[52] U.S. Cl. ..... 4/452; 4/450

[58] Field of Search ..... 4/450, 451, 452, 456

[56] References Cited

U.S. PATENT DOCUMENTS 959,379 5/1910 Otis ..... 4/456

3,609,771 10/1971 Avoy ..... 4/451

FOREIGN PATENT DOCUMENTS 2539985 8/1984 France ..... 4/452

*Primary Examiner*—Henry J. Recla

*Assistant Examiner*—Charles R. Eloshway

*Attorney, Agent, or Firm*—Robert M. Wallace

[57] ABSTRACT

An excrement collection and disposal apparatus for use with supine patients includes a flexibly resilient scoop which is configured to fit under the buttocks of the patient over an extended period of time with a minimum of discomfort. A liner is fitted over a portion of the scoop for minimizing contact between excrement and the scoop. In use, the excrement collection and disposal apparatus is placed beneath the patient such that excrement will be deposited onto the liner, and a handle portion of the scoop extends away from the buttocks between the patient's legs. Following a bowel movement, the apparatus is removed from beneath the patient and the liner is then removed from the scoop and discarded. Immediately thereafter a new liner is placed onto the scoop and the apparatus is replaced beneath the buttocks of the patient.

9 Claims, 2 Drawing Sheets

EXCREMENT COLLECTION AND DISPOSAL DEVICE AND METHOD

BACKGROUND OF THE INVENTION

This invention relates generally to bedpan-type devices utilized to collect excrement from bed-ridden patients. More specifically, the present invention relates to an excrement collection and disposal apparatus for use with bed-ridden patients, and a related process for collecting excrement from such a patient lying in a supine position.

Some types of illnesses and disabilities require that a patient be confined to a bed. This condition is commonly found among patients admitted to hospitals and convalescent homes, and even by those who have been discharged from such institutions to further convalesce at home. Although a patient may be confined to a bed, it is usually desirable that, if possible, the patient be able to take care of his or her own bladder and bowel movements. Traditionally, a bedpan has been provided to such patients which, when needed, the patient utilizes to collect urine and/or excrement in as sanitary a manner as is possible under the circumstances.

The use of a typical bedpan is not possible, however, by all patients. Some bed-ridden patients are too weak to properly use the bedpan, or are unable to control urination and bowel movements. Although most incontinent patients are catheterized to take care of urination, the patient too weak to use a traditional bedpan is left to simply defecate in bed. For many patients this is an uncomfortable and distasteful alternative which, in the past, could not be avoided.

In the hospital setting, such incontinent patients must be thoroughly cleaned three or four times a day. Moreover, even though disposable shields may be provided over a portion of the bed, the bed linen must also be changed regularly. Since many hospitals are financially strapped and understaffed, it is often the case that the incontinent patient must wait as much as two or three hours for assistance.

Accordingly, there has been a need for a novel device for collecting excrement from a bed-ridden patient lying in a supine position, who may be incapable of utilizing a traditional bedpan. Such a novel excrement collection device should be able to be placed under the buttocks of the patient in order to collect and confine excrement expelled from the patient during a bowel movement. Further, the novel collection device should be comfortable when so placed, easily removed from beneath the patient following a bowel movement, and provide for the convenient and sanitary disposal of the excrement. Moreover, a novel excrement collection and disposal apparatus is needed which can be left beneath the patient for long periods of time, is of sturdy construction, and can be manufactured inexpensively. The present invention fulfills these needs and provides other related advantages.

SUMMARY OF THE INVENTION

The present invention resides in an excrement collection and disposal device and a related method of use, which provides means for collecting excrement from a bed-ridden patient in a supine position, and then disposing of the excrement in an efficient and sanitary manner. In a preferred form of the invention, the collection and disposal device comprises a flexibly resilient scoop-like body which is configured to fit under the buttocks of a supine patient over an extended period of time with a minimum of discomfort. A liner is fitted over a first portion of the scoop for minimizing contact between excrement and the scoop. The scoop includes handle means shielded from the first portion of the scoop, for lifting and carrying the scoop, the liner and any excrement deposited thereon. The liner is removable from the scoop for disposal with the collected excrement.

The collection and disposal device thus described lends itself well to a process for collecting excrement from a bed-ridden patient lying in a supine position. Such a method includes the steps of placing the collection device or scoop beneath the buttocks of the patient such that the liner is positioned to collect excrement and the handle extends away from the buttocks between the patient's legs. Such placement of the scoop is typically done well before a bowel movement of the patient, and the scoop is left in place until after defecation. Following a bowel movement, the scoop is removed from beneath the patient, the liner is removed from the scoop-like body, and the liner, with the excrement deposited thereon, is then discarded. Since the liner is designed to prevent contact between excrement and the scoop, immediately after the soiled liner is disposed of, a new liner is replaced onto the scoop-like body and the assembly is then replaced beneath the buttocks of the patient.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
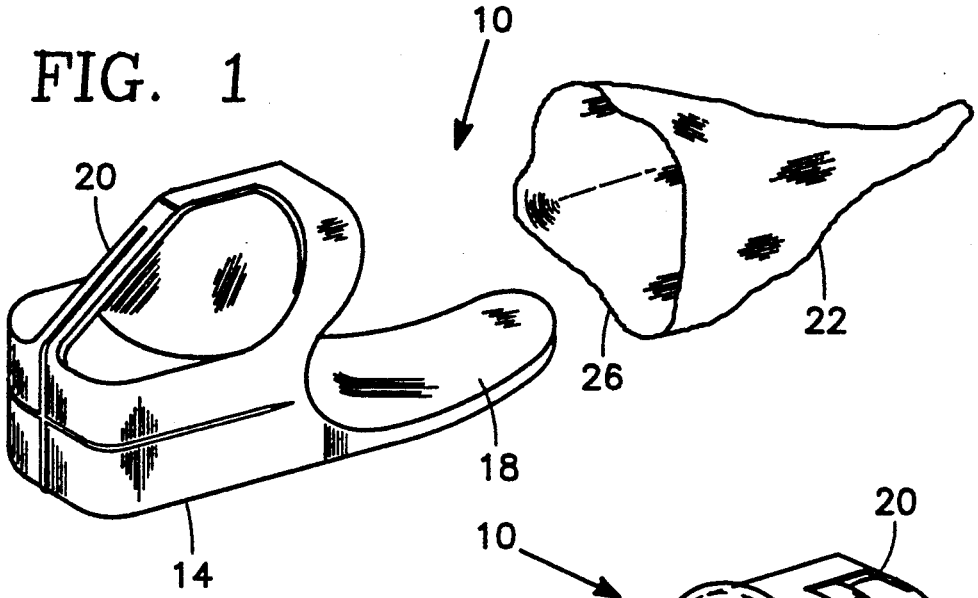
FIG. 1 is a top, rear and right side exploded perspective view of a liner and a scoop-like body comprising the excrement collection and disposal device of the present invention.

As shown in the drawings for purposes of illustration, the present invention is concerned with an excrement collection and disposal apparatus, generally designed in the accompanying drawings by the reference number 10. The apparatus 10 is intended to be utilized by bed-ridden patients 12 typically confined to lying in a supine position.

In accordance with the present invention, the excrement collection and disposal apparatus 10 comprises, generally, a flexibly resilient, scoop-like body 14 which is configured to fit under the buttocks 16 of the patient 12 over an extended period of time with a minimum of discomfort to the patient while lying in a supine position. The scoop-like body 14 is constructed to include a scoop portion 18 and a handle portion 20. The apparatus 10 further includes a biodegradable liner 22 which is configured to envelop the scoop portion 18 of the body 14.

The body 14 is preferably constructed of a resiliently flexible plastic material capable of being injection or blow molded into the desired shape. The scoop portion 18 forms a receptacle for excrement 24 when the body 14 is properly positioned beneath the buttocks 16 of the patient 12. The body 14 is constructed so that the handle portion 20 is shielded from the scoop portion 18, to provide a convenient means for lifting and carrying the scoop-like body 14, the liner 22 and any excrement 24 deposited onto the liner.

Figure 2:
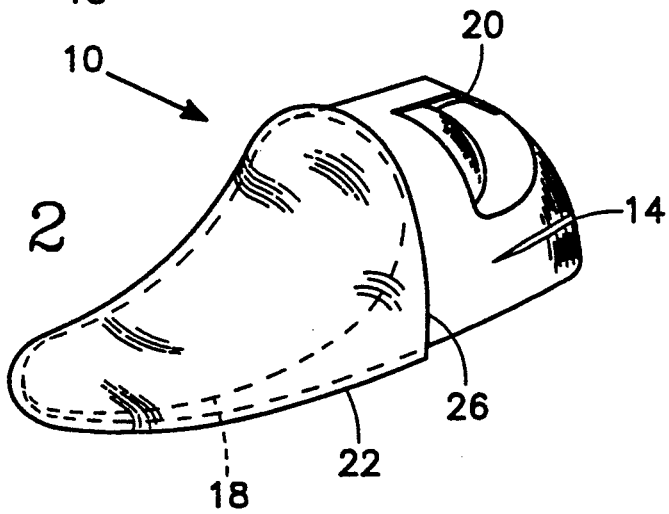
FIG. 2 is a top, front and left side perspective view of the excrement collection and disposal device illustrated in FIG. 1, showing the liner in place over a first portion of the scoop.
Figure 3:
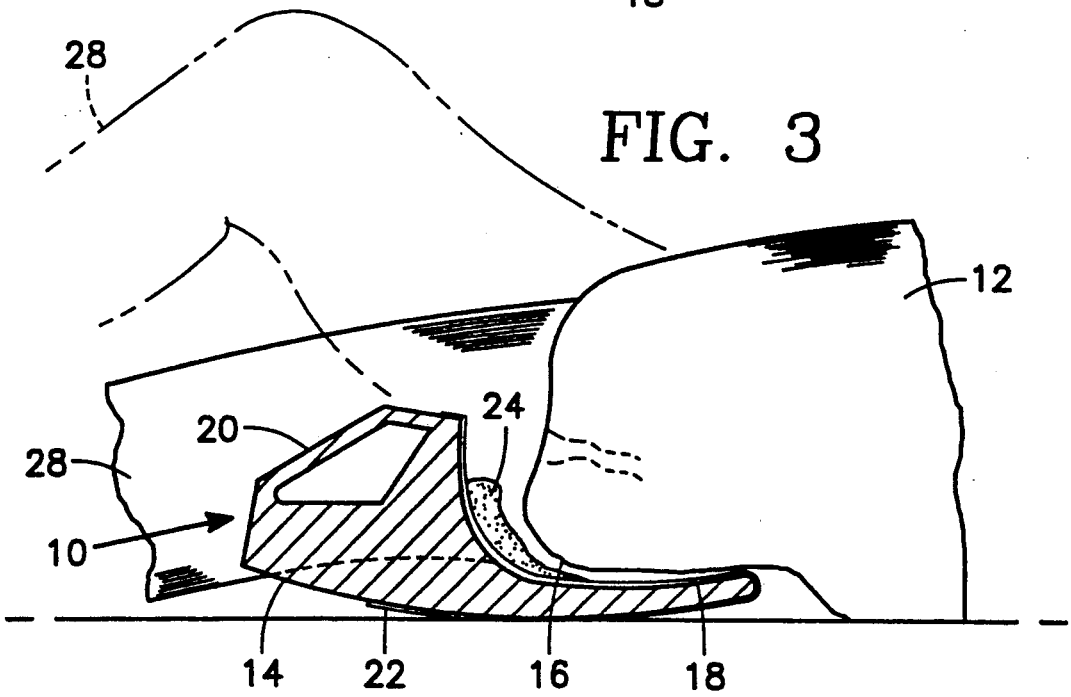
FIG. 3 is a sectional elevational view of the collection and disposal device illustrated in FIGS. 1 and 2, showing the manner in which the collection and disposal device is placed beneath the buttocks of a patient such that the first portion of the scoop is positioned to collect excrement following a bowel movement, and a handle extends away from the buttocks between the patient's legs.
Figure 4:
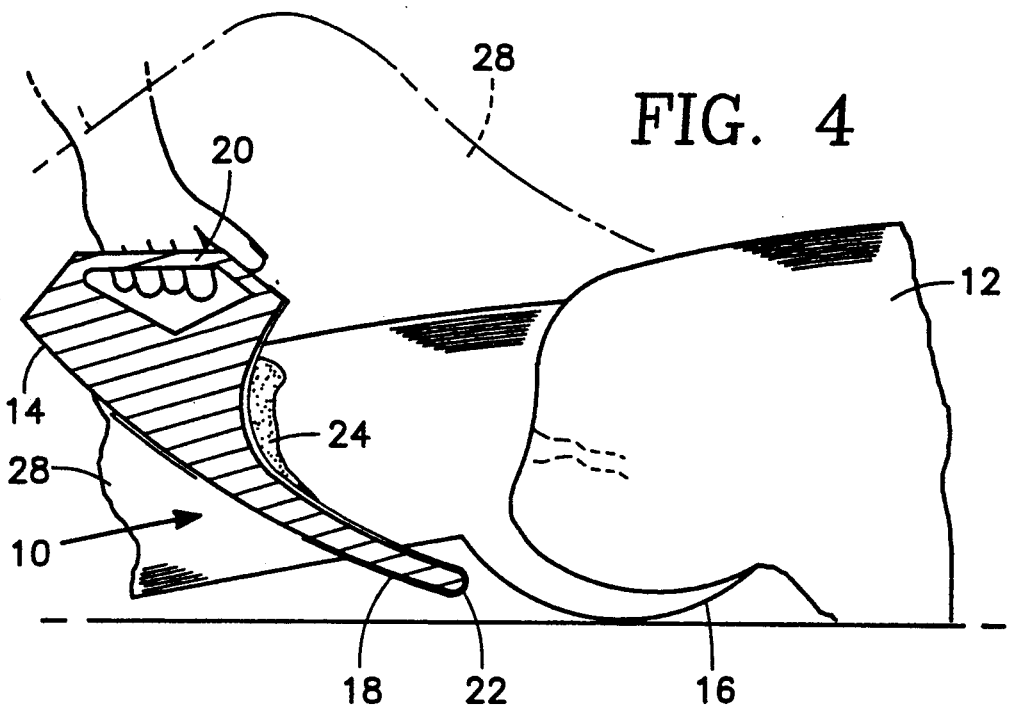
FIG. 4 is a sectional elevational view similar to that shown in FIG. 3, illustrating the manner in which the collection and disposal device is removed from beneath the patient following a bowel movement.
Figure 5:
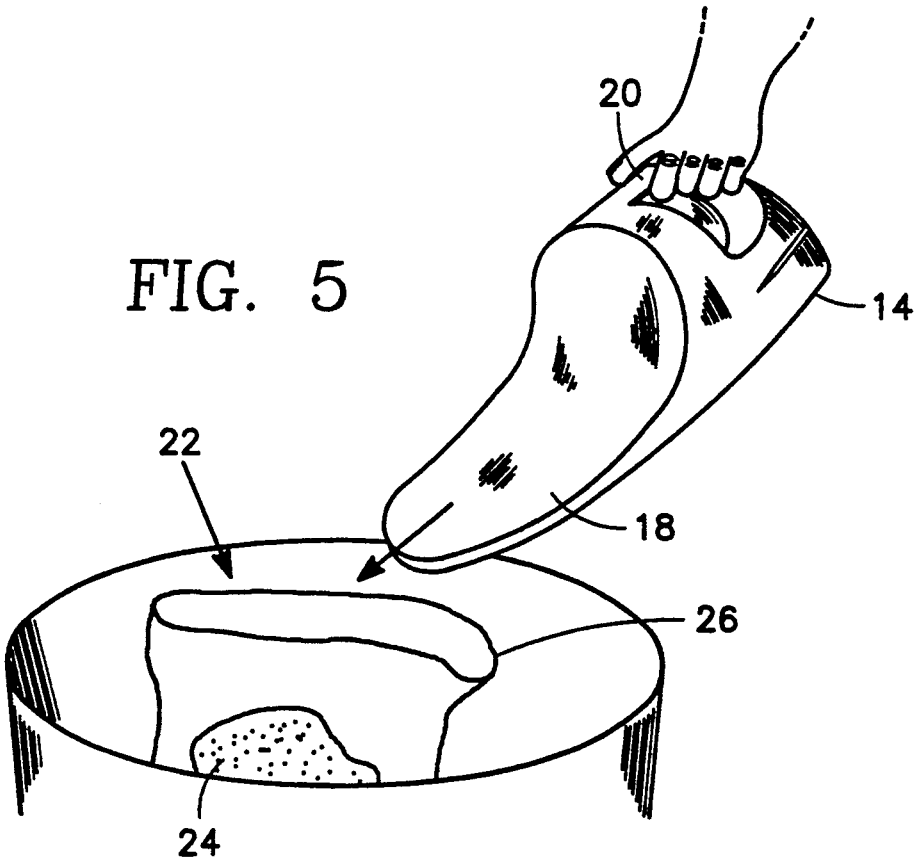
FIG. 5 is a perspective environmental view of the device shown in FIGS. 1–4, illustrating the manner in which the liner can be removed from the scoop to discard excrement deposited thereon.

To use the excrement collection and disposal apparatus 10 of the present invention, the liner 22, which is constructed to include a scoop-receiving aperture 26, is first placed over the scoop portion 18 of the body 14 as shown in FIGS. 1 and 2. This completed assembly, comprising the apparatus 10, is then placed beneath the buttocks 16 of the patient 12 as illustrated in FIG. 3. When so positioned, the liner 22 and the underlying scoop portion 18 of the body 14 are positioned adjacent to the anus in order to receive and contain excrement 24 during a bowel movement. The handle portion 20 extends between the patient's legs 28 to provide convenient means for removing the apparatus 10 from beneath the patient following a bowel movement (see FIG. 4). After the apparatus 10 having excrement 24 deposited onto the liner 22 is removed from beneath the patient 12, the liner 22 is removed from the body 14, and the excrement and liner are both discarded (FIG. 5). In this regard, it is preferred that the liner 22 be constructed of a paper-like material capable of being flushed down a toilet. The liner 22 is also configured to surround the scoop portion 18 of the body 14 in order to minimize or all together prevent contact between the excrement 24 and the scoop portion 18.

Immediately after the soiled liner 22 is discarded, a new, clean liner is refitted onto the scoop portion 18 of the body 14. The apparatus 10 is then repositioned beneath the buttocks 16 of the patient 12 as illustrated in FIG. 3. The apparatus 10 may be left in place, as illustrated, over an extended period time, and the patient experiences little or no discomfort because the body 14 is sufficiently flexible to deform under the weight of the patient.

From the foregoing it is to be appreciated that the excrement collection and disposal apparatus 10 of the present invention provides a simple yet highly effective means for collecting excrement from bed-ridden patients lying in a supine position, who are not otherwise able to utilize a traditional bedpan. By providing a liner 22 over the scoop portion 18 of the body 14, contact between the body 14 and excrement 24 is virtually eliminated. This minimizes the cleanup required following a bowel movement, thus making the entire process far more tolerable for the patient concerned.

Although a particular embodiment of the invention has been described in detail for purposes of illustration, various modifications may be made without departing from the spirit and scope of the invention. Accordingly, the invention is not to be limited, except as by the appended claims.

I claim:

1. A process for collecting excrement from a bed-ridden patient lying in a supine position, the steps comprising:

placing a resiliently flexible excrement collection scoop beneath the buttocks of the patient such that a first portion of the scoop will collect excrement, said first portion of the scoop having a generally rimless surface which interfaces with the buttocks of the patient, and a second portion of the scoop extends away from the buttocks between the patient's legs, the first portion of the excrement collection scoop being flexible and thin so as to be deformable under the weight of the patient and sufficiently resilient for supporting the weight of the excrement during transport and disposal and preconfigured to fit under the buttocks of the patient over an extended period of time with a minimum of discomfort to the patient while lying in a supine position;

removing the scoop from beneath the patient following a bowel movement by holding a handle on the second portion of the scoop, the handle extending away from the buttocks between the patient's legs and shielded from the first portion of the scoop;

discarding the excrement; and, immediately thereafter replacing the excrement collection scoop beneath the buttocks of the patient.

2. A process as set forth in claim 1, including the step of providing a removable liner over at least the first portion of the scoop.

3. A process as set forth in claim 2, wherein the step of discarding the excrement includes the steps of separating the liner from the scoop and disposing of the liner.

4. A process as set forth in claim 1, wherein the step of replacing the scoop beneath the buttocks of the patient, includes the step of providing a removable liner over at least the first portion of the scoop, and placing the scoop and the liner beneath the buttocks of the patient.

5. A process as set forth in claim 4, wherein the step of initially placing the collection scoop beneath the buttocks of the patient includes such placement of the scoop well before a bowel movement of the patient, and leaving the scoop in place until after the bowel movement.

6. A process as set forth in claim 5, including the steps of providing a removable liner over at least the first portion of the scoop, which liner prevents contact between excrement and the scoop, removing the scoop and the liner from beneath the patient following the bowel movement, separating the liner from the scoop, and disposing of the liner and the excrement deposited thereon.

7. A process for collecting excrement from a bed-ridden patient lying in a supine position, the steps comprising:

providing a resiliently flexible excrement collection scoop having a collection portion with a rimless surface which interfaces with the buttocks of the patient and which is flexible and thin so as to be deformable under the weight of the patient and sufficiently resilient to support the weight of the excrement during transport and disposal, and which is further pre-configured to fit under the buttocks of the patient over an extended period of time with a minimum of discomfort to the patient, wherein the scoop also includes a handle shielded from the collection portion for lifting and carrying the scoop in an upright, stable position;

providing a removable liner over at least the collection portion of the scoop;

placing the excrement collection scoop beneath the buttocks of the patient such that the liner is positioned to collect the excrement and the handle of the scoop extends away from the buttocks between the patient's legs, wherein such placement of the scoop occurs well before a bowel movement of the patient;

leaving the scoop and liner in place until after the bowel movement;

removing the scoop from beneath the patient following the bowel movement;

discarding the excrement by separating the liner from the scoop and disposing of the liner;

replacing a liner onto the scoop; and, replacing the flexible excrement collection scoop and liner beneath the buttocks of the patient.

8. An excrement collection and disposal apparatus for use with bed-ridden patients, the apparatus comprising:

a flexibly resilient scoop-like body having a collection portion with a rimless surface which interfaces with the buttocks of the patient and which is flexible and thin so as to be deformable under the weight of the patient and sufficiently resilient to support the weight of the excrement during transport and disposal, and configured to fit under the buttocks of a patient over an extended period of time with a minimum of discomfort to the patient while lying in a supine position;

a liner fitted over a first portion of the scoop-like body for minimizing contact between the excrement and the scoop-like body; and, handle means included in said scoop-like body and shielded from the first portion thereof, for lifting and carrying the body, the liner, and any excrement deposited thereon in an upright, stable position, said handle means extending away from the buttocks between the patient's legs.

9. An apparatus as set forth in claim 8, wherein the liner is removable from the scoop-like body for disposal with collected excrement.

* * * * *